United States Patent [19]

Mort et al.

[11] Patent Number: 4,613,556

[45] Date of Patent: Sep. 23, 1986

[54] HETEROGENEOUS ELECTROPHOTOGRAPHIC IMAGING MEMBERS OF AMORPHOUS SILICON AND SILICON OXIDE

[75] Inventors: Joseph Mort, Webster; Frank Jansen, Walworth; Koji Okumura, Rochester; Steven J. Grammatica, East Rochester; Michael A. Morgan, Penfield, all of N.Y.

[73] Assignee: Xerox Corporation, Stamford, Conn.

[21] Appl. No.: 662,328

[22] Filed: Oct. 18, 1984

[51] Int. Cl.[4] ..... G03G 5/082; G03G 5/085

[52] U.S. Cl. ..... 430/57; 430/60; 430/66; 430/84; 430/95

[58] Field of Search ..... 430/57, 60, 66, 67, 430/84, 95

[56] References Cited

U.S. PATENT DOCUMENTS

| | | | |
|---|---|---|---|
| 3,422,321 | 1/1969 | Tombs | 317/235 |
| 3,716,844 | 2/1973 | Brodsky | 340/173 LS |
| 4,237,150 | 12/1980 | Wiesmann | 427/74 |
| 4,254,161 | 3/1981 | Kemlage | 427/94 |
| 4,265,991 | 5/1981 | Hirai et al. | 430/64 |
| 4,271,582 | 6/1981 | Shirai et al. | 29/571 |
| 4,273,805 | 6/1981 | Dawson et al. . | |
| 4,297,392 | 10/1981 | Higashi et al. | 427/75 |
| 4,330,182 | 5/1982 | Coleman | 352/2 |
| 4,333,964 | 6/1982 | G'hezzo | 427/93 |
| 4,356,246 | 10/1982 | Tabei et al. | 430/136 |
| 4,357,179 | 11/1982 | Adams et al. | 148/1.5 |
| 4,361,638 | 11/1982 | Higashi et al. | 430/58 |
| 4,365,013 | 12/1982 | Ishioka et al. | 430/57 |
| 4,377,628 | 3/1983 | Ishioka et al. | 430/57 |
| 4,378,417 | 3/1983 | Maruyama et al. | 430/57 |
| 4,394,426 | 7/1983 | Shimizu et al. | 430/65 |
| 4,409,308 | 10/1983 | Shimizu et al. | 430/65 |
| 4,443,529 | 4/1984 | Kanbe et al. | 430/65 |
| 4,510,224 | 4/1985 | Yamazaki et al. | 430/58 |
| 4,517,269 | 5/1985 | Shimizu et al. | 430/57 |

*Primary Examiner*—John L. Goodrow

*Attorney, Agent, or Firm*—E. O. Palazzo

[57] ABSTRACT

Disclosed is an electrographic imaging member consisting essentially of a supporting substrate, a hydrogenated amorphous silicon photogenerating layer, and in contact therewith a charge transporting layer of plasma deposited silicon oxide containing at least 50 atomic percent of oxygen.

62 Claims, 3 Drawing Figures

HETEROGENEOUS ELECTROPHOTOGRAPHIC IMAGING MEMBERS OF AMORPHOUS SILICON AND SILICON OXIDE

BACKGROUND OF THE INVENTION

This invention is generally directed to the use of amorphous silicon compositions in electrophotographic imaging members, and more specifically, the present invention is directed to photoresponsive layered imaging members, or devices comprised of hydrogenated amorphous silicon and silicon oxides. In one embodiment of the present invention, there is provided a layered photoresponsive imaging member comprised of a supporting substrate, hydrogenated amorphous silicon, and in contact therewith a layer comprised of plasma silicon oxide. Further, in an alternative embodiment of the present invention, there is provided a layered photoresponsive imaging member wherein the plasma generated silicon oxide transporting layer is situated between a supporting substrate and the hydrogenated amorphous silicon layer. These imaging members can be incorporated into electrographic, and in particular xerographic printing systems, wherein the latent electrostatic images which are formed, can be developed into images of high quality, and excellent resolution. Moreover, these members possess high charge acceptance values, in excess of 1,000 volts, and the members can be of very desirable thickness from for example, of about 10 microns, or less. Also, the imaging members of the present invention have desirable low dark decay properties, and are thus very useful in xerographic imaging processes. In these processes, latent electrostatic images are formed on the devices involved, followed by developing the images with known developer cmpositions, subsequently transferring the image to a suitable substrate, and optionally permanently affixing the image thereto. The photoresponsive imaging members of the present invention, when incorporated into xerographic imaging, and printing systems, are insensitive to humidity conditions and corona ions generated from corona charging devices, enabling these members to generate acceptable images of high resolution for an extended number of imaging cycles exceedng, in most instances, more than 500,000 imaging cycles.

Electrostatographic imaging, and particularly xerographic imaging processes are well known, and are extensively described in the prior art. In these processes generally, a photoresponsive or photoconductor material is selected for forming the latent electrostatic image thereon. This photoreceptor is generally comprised of a conductive substrate containing on its surface a layer of photoconductive material, and in many instances, a thin barrier layer is situated between the substrate and the photoconductive layer to prevent charge injection from the substrate, which injection would adversely affect the quality of the resulting image. Examples of known useful photoconductive materials include amorphous selenium, alloys of selenium, such as selenium-tellurium, selenium-arsenic, and the like. Additionally, there can be selected as the photoresponsive imaging member various organic photoconductive materials, including for example, complexes of trinitrofluorenone and polyvinylcarbazole. Moreover, recently, there has been disclosed multilayered organic photoresponsive devices comprised of an aryl amine hole transporting molecule dispersed in an inactive resinous binder, and a photogenerating layer, reference U.S. Pat. No. 4,265,990, the disclosure of which is totally incorporated herein by reference. Examples of charge transport layers disclosed in this Patent include various diamines, while examples of photogenerating layers are trigonal selenium, metal and metal-free phthalocyanines, vanadyl phthalocyanines, squarine compositions, and other similar substances.

Additionally amorphous silicon photoconductors are known, thus for example there is disclosed in U.S. Pat. No. 4,265,991 an electrophotographic photosensitive member comprised of a substrate, a barrier layer, and a photoconductive overlayer of amorphous silicon containing 10 to 40 atomic percent of hydrogen and having a thickness of 5 to 80 microns. Further described in this patent are several processes for preparing amorphous silicon. In one process embodiment, there is prepared an electrophotographic sensitive member by heating the member in a chamber to a temperature of 50° C. to 350° C., introducing a hydrogen containing gas into the vacuum chamber, causing an electrical discharge by electric energy to ionize the gas, in the space of the chamber in which a silicon compound is present, followed by depositing amorphous silicon on an electrophotographic substrate at a rate of 0.5 to 100 Angstroms per second, thereby resulting in an amorphous silicon photoconductive layer of a predetermined thickness. While the amorphous silicon device described in this patent is photosensitive, after a minimum number of imaging cycles, less than about 10, for example, unacceptable low qaulity images of poor resolution, with many deletions, result. With further cycling, that is, subsequent to 10 imaging cycles and after 100 imaging cycles, the image quality continues to deteriorate, often unit images are partially deleted. Accordingly, while the amorphous silicon photoresponsive device of U.S. Pat. No. 4,265,991 patent is useful, its selection as a commercial device which can be used functionally for a number of imaging cycles is not readily achievable.

There is also disclosed in a copending application, U.S. Ser. No. 524,801, the disclosure of which is totally incorporated herein by reference, imaging members comprised of compensated amorphous silicon compositions, wherein there is simultaneously present in the amorphous silicon dopant materials of boron and phosphorous. More specifically there is disclosed in the copending application a photosensitive device comprised of a supporting substrate, and an amorphous silicon composition containing from about 25 parts per million by weight to about 1 weight percent of boron, compensated with from about 25 parts per million by weight to about 1 weight percent of phosphorous.

Moreover, disclosed in U.S. Pat. Ser. No. 4,544,617, the disclosure of which is totally incorporated herein by reference, is an imaging member comprised of a supporting substrate, a carrier transport layer comprised of uncompensated or undoped amorphous silicon, or amorphous silicon slightly doped with p or n type dopants such as boron or phosphorous, a thin trapping layer comprised of amorphous silicon which is heavily doped with p or n type dopants such as boron or phosphorous, and a top overcoating layer of silicon nitride, silicon carbide, or amorphorous carbon, and wherein the top overcoating layer can be optionally rendered partially conductive.

While the above described imaging members, particularly those disclosed in the copending applications are suitable for their intended purposes, there continues to be a need for improved imaging members comprised of amorphous silicon. Additionally, there is a need for very thin imaging members of amorphous silicon compositions less than, for example about 10 mircons in thickness, that posses desirable high charge acceptance and low charge acceptance loss in the dark. Also there is a need for layered imaging members comprised of amorphous silicon photogenerating substances, and in contact therewith charge transport layers. Furthermore there continues to be a need for improved amorphous silicon imaging members with silicon oxide, and wherein there is introduced into the silicon oxide charge transport layer electronic defect states by stoichiometric control of dopants, (impurities) of sufficient density enabling transport to be accomplished by hopping between the resulting localized states. These states are positioned within the band gap of the silicon oxide itself, thus the injection of carriers from the amorphous silicon photogenerating layer can be more easily effected by, for example, choice of the defect state, and by compositional grading of the interface between the photogenerating and transport layer. Additionally there continues to be a need for improved layered imaging members of amorphous silicon which are humidity insensitive and are not adversely effected by electrical consequences resulting from scratching and abrasion. There is also a need for amorphous silicon imaging members which can be selected for use in repetitive imaging and printing systems. Furthermore there is a need for amorphous silicon imaging members with the property of low surface potential decay rates in the dark, and yet are photosensitive in the visible and near visible wavelength range.

SUMMARY OF THE INVENTION

It is therefore an object of the present invention to provide photoresponsive imaging members with high charge acceptance and low dark decay characteristics.

In another object of the present invention there are provided layered imaging members comprised of amorphous silicon and in contact therewith a layer comprised of certain silicon oxide compositions.

In a further object of the present invention there are provided layered photoconductive imaging members comprised of a charge transport layer with certain silicon oxide films situated between a supporting substrate and a photogenerating layer comprised of amorphous silicon.

In yet another object of the present invention, there are provided layered photoresponsive imaging members wherein inorganic defect matrices enable sufficient localized defect density to create the conditions necessary for carrier transport of photogenerated carriers, efficiently injected from the contiguous photogenerator layer by hopping between localized states within the band gap of the material.

In yet another object of the present invention, there are provided layered photoresponsive imaging members which are rendered photosensitive in the near infrared by suitable alloying of the amorphous silicon photogeneration layer with germanium and tin, or compositions based on carbon and germanium.

These and other objects of the present invention are accomplished by the provision of a multilayered amorphous silicon photoresponsive imaging member. More specifically, in accordance with the present invention, there are provided layered photoresponsive imaging members consisting essentially of amorphous silicon, and in contact therewith a layer comprised of silicon oxide of which the atomic oxygen concentration exceeds 50%. In one specific embodiment of the present invention there is provided a photoresponsive imaging member comprised of a supporting substrate, a photogenerating layer of amorphous silicon in contact therewith, a charge transport layer comprised of plasma deposited silicon oxide, and a top protective overcoating layer. Alternatively, the hole transport layer can be situated between the amorphous silicon photogenerating layer and the supporting substrate. The photoresponsive imaging members illustrated when incorporated into xerographic imaging systems possess high charge acceptances, of 100 volts per micron or greater, possess very low dark decay characteristics and importantly, these members can be fabricated with the desirable properties in thicknesses of 10 microns, or less.

Therefore, the photoresponsive members of the present invention can be incorporated into various imaging systems, and particularly xerographic imaging systems, as indicated herein. In these systems, latent electrostatic images are formed on the members involved, followed by developing the images with known developer compositions, subsequently transferring the image to a suitable substrate, and optionally permanently affixing the image thereto. Moreover, the photoresponsive imaging members of the present invention can be selected for use in xerographic printing systems, inclusive of those with solid state lasers or electroluminescent light sources, as these members can be rendered sufficiently sensitive to wavelengths of up to 7800 Angstroms when the photogeneration layer is suitably alloyed with germanium or tin or fabricated from germanium-carbon alloys. The photoresponsive imaging members of the present invention when incorporated into these systems are insensitive to humidity conditions and corona ions generated from corona charging devices, enabling these members to generate acceptable images of high resolution for an extended number of imaging cycles exceeding, in most instances, 500,000 imaging cycles, and approaching over two million imaging cycles.

BRIEF DESCRIPTION OF THE DRAWINGS

For a better understanding of the present invention and further features thereof, reference is made to the following detailed description of the preferred embodiments wherein.

Figure 1:
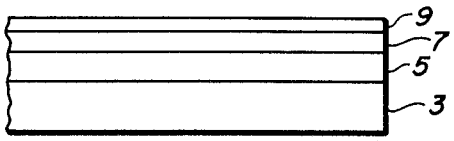
FIG. 1 is a partially schematic cross-sectional view of the photoresponsive imaging member of the present invention.

Illustrated in FIG. 1 is a photoresponsive imaging member of the present invention, comprised of a supporting substrate 3, a transport layer of plasma deposited silicon oxide 5, of a thickness of from about 1 to 10 microns, a photogenerating layer of for example amorphous silicon 7, of a thickness of from about 0.5 to 2 microns, and a transparent and partially conductive top overcoating layer 9, of a thickness of from about 0.1 to 0.5 microns.

Figure 2:
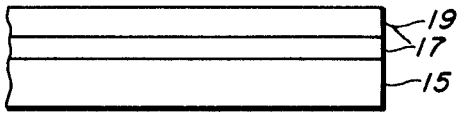
FIG. 2 is a partially schematic cross-sectional view of a further photoresponsive imaging member of the present invention.

Illustrated in FIG. 2 is a photoresponsive imaging member of the present invention comprised of a supporting substrate 15, a photogenerating layer of amorphous silicon 17, of a thickness of from about 0.5 microns to about 2 microns, and a charge transport layer 19, comprised of plasma deposited silicon oxide prepared for the imaging members of FIG. 1 and FIG. 2, by the glow discharge of a mixture of nitrous oxide and a silane gas, which layer is of a thickness of from about 1 micron to about 10 microns. The silicon oxide film ($SiO_x$), is colorless and evidences no xerographic sensitivity, that is, no photodischarge was measured when the silicon oxide was incorporated without a hydrogenated amorphous silicon film into the photoresponsive imaging member of the present invention. The member, with the photogenerating layer situated between the charge transport layer and the supporting substrate, may also include a top overcoating protective layer.

Figure 3:
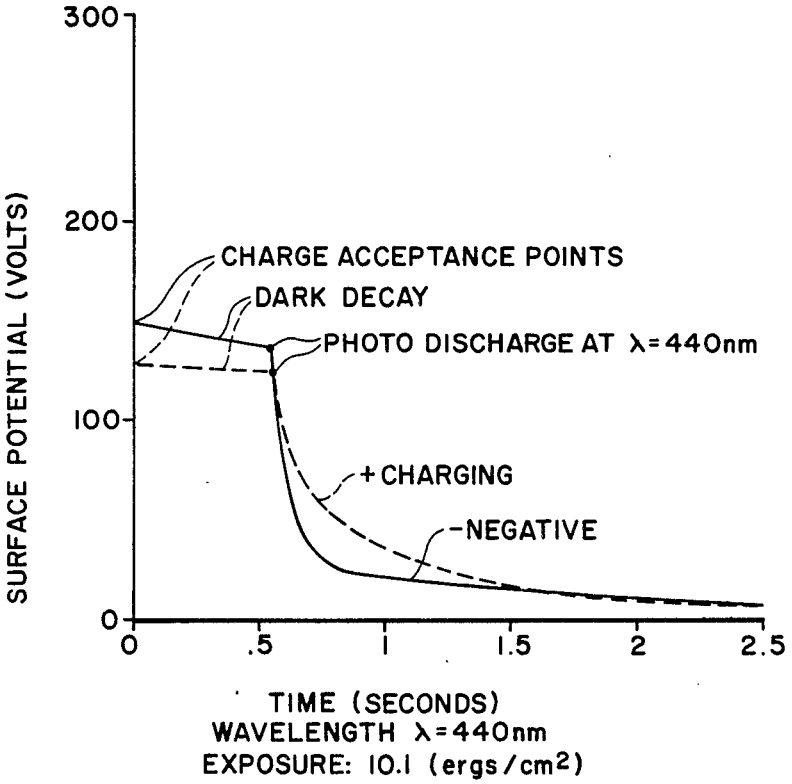
FIG. 3 is a line graph representing the high charge acceptance and low dark decay characteristics of an imaging member with a thickness of 0.5 microns for the photogenerator layer, and 1.0 microns of the silicon oxide transport layer.

Illustrated in FIG. 3 are line graphs for positively, and negatively charged imaging members of a silicon oxide transport layer in a thickness of 1.0 microns, and coated thereover in a thickness of 0.5 microns a photogenerating layer of hydrogenated amorphous silicon. These line graphs illustrate the surface potential in volts for the time in seconds shown. These photodischarge curves indicate excellant contrast potential, therefore developed images of high quality will be generated when the members involved are incorporated into a xerographic imaging process. Substantially similar electrical properties will result when the imaging members involved include a protective overcoating.

In combination with a hydrogenated amorphous silicon layer, the silicon oxide film deposited prior to, as illustrated in FIG. 2, or subsequent to, as shown in FIG. 1, results in an imaging member that is photosensitive in both the positive and negative charging mode for both configurations. It is apparent, although the scope of this invention is not limited by theory, that a charge transport channel, or a manifold of charge transport channels in the silicon oxide film can be accessed by photogenerated carriers in the hydrogenated amorphous silicon. Also the charge transport manifold most likely contains a high density of localized states in the forbidden gap of the silicon oxide. The high density permits the charge to transfer or hop from site to site thus rendering what is commonly perceived as an insulator to be conductive of injected carriers. The ambipolar nature of the device indicates that the energy of the transport states is such that they are situated between the conduction and the valence band of the amorphous silicon when brought into contact wih the silicon oxide. Also the transport manifold in the silicon oxide is bracketed in energy by the transport states through which photo excited carriers in the amorphous silicon move; and is thus energetically accessible to both types of carriers.

The charge transport process through the silicon oxide layer is probably controlled by charge hopping through energy states which are associated with certain bonding defects as evidenced by the stoichiometric control which can be exercised over the charge transport process. Additionally, the creation of more bonding defects by the irradiation of the silicon oxide film by energic radiation such as neutron irradiation, high energy gamma irradiation or electron irradiation generally improves the carrier mobility through the oxide layer, and yields a device with small residual voltages.

The silicon oxide film may optionally contain an amount of nitrogen which, depending on the conditions of device fabrication, may range from about a few percent to in excess of 25 percent. With the simultaneous presence of oxygen and nitrogen, the resulting material is sometimes referred to as silicon oxy-nitride films. However, the common physical characteristics of the oxide film materials, including transparency in the visible wavelength range, and mechanical hardness of the same order of magnitude as the amorphous silicon films, are largely independent of the nitrogen concentration.

Furthermore, the change injection process from the amorphous silicon into the silicon oxide layer can be facilitated by compositionally grading the interface between the silicon and the silicon oxide layer with from zero percent atomic oxygen to about 70 atomic percent oxygen, over a gradient distance of up to about 50 microns. In this fashion, the effect of built-iin electrical fields due to band bending at the interface is minimized. Another method which can be used to control the band bending at the interface is with p or n-type doping of the amorphous silicon by inclusion of, for example, boron or phosphorous compounds in the oxide layer. Thus, energy barriers which may exist at the interface can be minimized by control of the electron affinities of the solids.

The inclusion of other elements, such as germanium or tin in the hydrogenated amorphous silicon film can easily be accomplished by the simultaneous glow discharge of, for example, silane and germane, or stannane. The alloying of silicon with germanium and/or tin is useful because the band gap of the alloy is smaller than that of the hydrogenated amorphous silicon itself; and therefore a photoresponse to longer wavelengths is obtained.

The supporting substrates for each of the imaging members illustrated in the Figures may be opaque or substantially transparent, and may comprise various suitable material having the requisite mechanical properties. Thus, this substrate can be comprised of numerous substances providing the objectives of the present invention are achieved. Specific examples of substrates include insulating materials such as inorganic or organic polymeric materials; a layer of an organic or inorganic material having a semiconductive surface layer thereon, such as indium tin oxide; or a conductive material such as, for example, aluminum, chromium, nickel, brass, stainless steel, or the like. The substrate may be flexible or rigid and may have many different configurations such as, for example, a plate, a cylindrical drum, a scroll, an endless flexible belt, and the like. Preferably the substrate is in the form of a cylindrical drum, or endless flexible belt. In some situations, it may be desirable to coat on the back of the substrate, particularly when the substrate is an organic polymeric material, an anticurl layer, such as, for example, polycarbonate materials, commercially available as Makrolon. The substrates are preferably comprised of aluminum, stainless steel sleeve, or an oxidized nickel composition.

The thickness of the substrate layer depends on many factors including economical considerations, and required mechanical properties. Accordingly, thus this layer can be of a thickness of from about 0.01 inches to about 0.2 inches, and preferably is of a thickness of from about 0.5 inches to about 0.15 inches. In one particularly preferred embodiment, the supporting substrate is comprised of oxidized nickel in a thickness of from abut 1 mil to about 10 mils.

Illustrative examples of materials selected for the photogenerating layer are hydrogenated, preferably with 10 to 40 percent of hydrogen, amorphous silicon, especially amorphous silicon. Especially useful photogenerating materials include compensated amorphous silicon as described in the copending application referred to hereinbefore. More specifically as indicated herein there is disclosed in this copending application an amorphous silicon composition with from about 25 parts per million by weight to about one weight percent of boron compensated with from about 25 parts per million by weight to about one weight percent of phosporous.

A critical layer with respect to the imaging members of the present invention is the silicon oxide charge transporting composition. These compositions are prepared by the glow discharge of a mixture of nitrous oxide and silane gas. Thus the photoresponsive imaging members of the present invention, are generally prepared in accordance with the processes as described in the copending applications referred to hereinbefore. More specifically, thus the imaging members of the present invention can be prepared by simultaneously introducing into a reaction chamber, a silane gas, often in combination with other gases for the purpose of doping or alloying, followed by the introduction of silane gas and nitrous oxide. In one specific embodiment, the process of preparation involves providing a receptacle containing therein a first substrate electrode means, and a second counterelectrode means, providing a cylindrical surface on the first electrode means, heating the cylindrical surface with heating elements contained in the first electrode means, while causing the first electrode means to axially rotate introducing into the reaction vessel a source of silicon containing gas, often in combination with other diluting doping or alloying gasses at a right angle with respect to the cylindrical member, applying a voltage between the first electrode means, supplying a current to the second electrode means, whereby the silane gas is decomposed resulting in the deposition of amorphous silicon, or doped amorphous silicon on the cylindrical member. Thereafter there is introduced into the reaction chamber a mixture of silane gas and nitrous oxide, and upon exposure to the glow discharge there is deposited on the amorphous silicon a layer of plasma silicon oxide. When nitrous oxide is used as the oxidizing agent for the silane gas, useful charge transporting silicon oxide compositions are obtained, especially for a gas mixing ratio of between 5:1 and 20:1 parts of nitrous oxide to silane. This gas mixture is introduced in the vacuum chamber at a combined flow rate of between 50 and 350 standard cubic centimeters per minute for the preparation of the single layered no top overcoating, member of the present invention. The gas mixture pressure is maintained constant at between 50 and 650 milli-Torr and the radio frequent electrical power density is between 0.01 and 1 $W/cm^2$ of electrode area. The substrate temperature during the deposition process can be between room temperature and 300° C.

The process and apparatus useful for preparing the photoresponsive devices of the present invention are specifically disclosed in copending application U.S. Ser. No. 456,935, filed on Jan. 10, 1983, the disclosure of this application being totally incorporated herein by reference. Specifically the apparatus disclosed in the copending application, is comprised of a rotating cylindrical first electrode means 3 secured on an electrically insulating shaft; radiant heating element 2 situated within the first electrode means 3; connecting wires 6; a hollow shaft rotatable vacuum feedthrough 4; a heating source 8; a hollow drum substrate 5 containing therein the first electrode means 3, the drum substrate being secured by end flanges, which are part of the first electrode means 3; a second hollow counterelectrode means 7, with flanges thereon 9 and slits or vertical slots 10 and 11; receptacle or chamber means 15; containing as an integral part thereof receptacles 17 and 18 for flanges 9 for mounting the module in the chamber 15, a capacitive manometric vacuum sensor 23, a gauge 25, a vacuum pump 27, with a throttle valve 29, mass flow controls 31, a gauge and set point box 33, gas pressure vessels 34, 35, and 36, for example, pressure vessel 34 containing silane gas, and nitrous oxide, a radio frequent electrical power source means 37 for the first electrode means 3 and a second counterelectrode means 7. The chamber 15 has an entrance means 19 for the source gas material and an exhaust means 21 for the unused gas source material. In operation the chamber 15 is evacuated by vacuum pump 27 to appropriate low pressures. Subsequently, a silane gas, often in combination with other gases originating from the vessels 34, 35 and 36 are simultaneously introduced into the chamber 15 through entrance means 19, the flow of the gases being controlled by the mass flow controller 31. These gases are introduced into the entrance 19 in a cross-flow direction, that is the gas flows in the direction perpendicular to the axis of the cylindrical substrate 15, contained on the first electrode means 3. Prior to the introduction of the gases, the first electrode means is caused to rotate by the motor and power is supplied to the radiant heating elements 2 by heating source 8, while electrical power is applied to the first electrode means and the second counterelectrode means by a power source 37. Generally, sufficient power is applied from the heating source 8 that will maintain the drum 5 at a temperature ranging from about 150° C. to about 350° C. The pressure in the chamber 15 is automatically regulated so as to correspond to the settings specified at gauge 25 by the position of throttle valve 29. Electrical field created between the first electrode means 3 and the second counterelectrode means 7 causes the silane gas to be decomposed by glow discharge whereby amorphous silicon based materials are deposited in a uniform thickness on the surface of the cylindrical means 5 contained on the first electrode means 3. There thus results on the substrate an amorphous silicon based film. Multilayer structures are formed by the sequential introduction and decomposition of appropriate gas mixtures for the appropriate amounts of time. Thereafter a mixture of silane gas and nitrous oxide in amounts between 5:1 and 20:1 nitrous oxide to silane is introduced into the chamber as described before.

The amorphous silicon photogenerating layer is deposited by the glow discharge decomposition of a silane gas alone, or in the presence of small amounts of dopant gases such as diborane and/or phosphine. The range of useful flow rates, radio frequent power levels and reactor pressures are approximately the same as that described with reference to the deposition of the silicon oxide layer. During the photogenerating layer deposition the substrate temperature is between about 150° C. to about 350° C.

Passivating, and protecting overlayers such as layer 9 in FIG. 1 can be fabricated from a variety of materials. Very useful are silicon nitride layers plasma deposited from, for example, silane and ammonia mixtures. The electrical conductivity of the passivation layer should not exceed about $10^{12}$ ohm-cm, and can be controlled by the proper choice of gas mixture ratios. Other useful overcoating materials are silicon carbide, plasma deposited from silane and hydrocarbon gas, silicon oxide plasma deposited from silane and a gaseous nitrogen oxygen compound, and amorphous carbon, plasma deposited from a hydrocarbon gas source.

Similarly, other gases and gas mixtures can be used to fabricate photoresponsive silicon-silicon oxide members with properties which are essentially equivalent to those of the imaging members described hereinbefore. These gases include a disilane gas instead of silane, other nitrogen-oxygen gases, such as nitric oxide and nitrogen dioxide, instead of nitrous oxide; and further the glow discharge decomposition of tetraethoxy-silane in the presence of oxygen can be selected.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

An amorphous silicon-silicon oxide photoreceptor was fabricated on 9.5" diameter cylindrical aluminum drums, of 16.75" length by first heating to 200° C. the drum substrates in a vacuum system which was similar in construction to the apparatus disclosed in copending application U.S. Ser. No. 456,935, FIG. 3. Nitrous oxide gas and monosilane gas were subsequently introduced into the vacuum system at flow rates of 200 standard cubic centimeters per minute (sccm) and 20 sccm respectively. The system pressure for this mixture was determined by a throttle valve in the vacuum exhaust line and held constant at 250 milliTorr. The glow discharge, initiated at this pressure and maintained for three hours, was excited by a radio frequent power supply with a frequency of 100 kHz at a net power level of 100 W. The drum blank, electrically connected to the power supply by slip rings, was rotated during the deposition of the films at a rotational speed of 5 rpm. The counterelectrode was stationary and electrically grounded. Without breaking the vacuum, an amorphous hydrogenated silicon film was deposited subsequent to the deposition of the silicon oxide film by terminating the nitrous oxide gas stream and increasing the silane gas stream to 200 sccm. The silane discharge was continued for 20 minutes after which the electrical discharge to the drum was discontinued. Subsequently a mixture of 2:1 ammonia to silane gas was introduced into the reactor at a combined flow rate of 200 sccm, and at a pressure of 250 milliTorr. This mixture was plasma deposited for 6 minutes at a power of 100 watts after which the electrical discharge, and heating to the drum were discontinued. The drum member was removed from the vacuum system and was found by microscopic inspection techniques to consist of 10 microns of silicon oxide, followed by a one-half micron layer of amorphous silicon, and a 3,000 Angstroms layer of a silicon nitride overcoating. This drum was incorporated in a xerographic imaging machine fabricated by Xerox Corporation, Webster, NY and known as the 5400 ®model. Images of excellent resolution, no blurring, were obtained for up to 1,000 cycles, at which time the test was discontinued.

EXAMPLE II

An amorphous silicon-silicon oxide photoreceptor is fabricated as described in Example I with the exception that the order of deposition of the silicon oxide and the silicon layer is interchanged. Thus, a xerographic imaging member is obtained which consists of a 0.5 micron layer of hydrogenated amorphous silicon in contact with the substrate, a ten micron layer of silicon oxide thereover, and an overcoating of silicon nitride. This device is incorporated into the xerographic printing machine known as the Xerox Corporation 5700® model, fabricated by Xerox Corporation, Webster, NY. Images of excellent resolution can be obtained for up to 10,000 cycles at a temperature of 19° C., and a relative humidity of 75%.

EXAMPLE III

An amorphous silicon oxide layer of 10 microns thick is fabricated in accordance with the method disclosed in Example I. Upon removal of the drum substrate with the silicon oxide film from the vacuum system, the member is neutron irradiated with a high energy beam at the equivalent dosage of 10 megarads. The drum member is rotated during the irradiation process to ensure a uniform radiation dosage across the film surface. Subsequently, the sample is remounted in the vacuum system and heated to a temperature of 230° C. Silane gas is then introduced at a flow rate of 200 sccm, and a D.C. glow discharge of 100 milliamps current at a voltage of 750 is maintained for 15 minutes. A gas mixture of 50 sccm of silane and 125 sccm of ammonia is then admitted to the vacuum chamber at a total pressure of 250 milliTorr, and is plasma deposited for 15 minutes in a D.C. discharge of 100 milliamps of current and a voltage of 750. Upon removal from the vacuum system, the resulting photoreceptor is mounted in an electrical scanner.

The charger acceptance of the resulting device can exceed 950 volts about 1 second after charging it positively with a corona device. Excellent photodischarge characteristics can also be obtained with blue light of a wavelength of 4400 Angstroms. The residual voltage after photo discharge is smaller than 73 volts when the light exposure is adjusted to a level of $10^{13}$ photons/cm$^2$. When this photoreceptor is incorporated in a Xerox Corporation 5400® copier/duplicator, images of excellent resolution can be obtained for 1,000 imaging cycles.

EXAMPLE IV

An imaging member can be fabricated by repeating the procedure of Example II with the following modification. A transition between the amorphous silicon and silicon oxide layer is obtained by gradually decreasing the silane flow from 200 sccm, to 20 sccm, and simultaneously increasing the nitrous oxide flow from zero to 200 sccm over the course of 30 minutes. Upon testing of the resulting device in an electrical scanner, it can be determined that the device will show comparable charge and discharge characteristics to the photoreceptor of Example II, however, the residual voltage upon discharge is considerably smaller for the graded transition member, about 65 volts, compared to 123 to 139 volts for samples fabricated according to Example II.

EXAMPLE V

Imaging members can be fabricated by repeating the procedure of Example I with the following modification. During the deposition of the amorphous silicon, the silane flow rate is adjusted to 100 sccm, and 100 sccm of germane is added to the gas stream. Thus, a photoreceptor structure is created with a top layer of an alloy of hydrogenated silicon and germanium. Upon mounting this structure in an electrographic scanner, it can be determined that the charging and discharging characteristics will be similar to the member of Example I, however, the member of Example V will have increased sensitivity to light in the wave length region of 7500–8000 Angstroms. This increased sensitivity can be demonstrated by the increase in the rate of photo discharge with a light exposure of $10^{13}$ photons/$cm^2$.

Although the invention has been described with reference to specific preferred embodiments, it is not intended to be limited thereto. Rather those of skill in the art will recognize that variations and modifications may be made therein which are included within the spirit of the present invention and within the scope of the following claims.

We claim:

1. An electrographic imaging member consisting essentially of a supporting substrate, a hydrogenated amorphous silicon photogenerating layer, and in contact therewith a charge transporting layer of plasma deposited amorphous silicon oxide of a thickness exceeding 1 micron and containing at least 50 atomic percent of oxygen.

2. An imaging member in accordance with claim 1, further including a protective top overcoating layer.

3. An imaging member in accordance with claim 2, wherein the silicon oxide charge transport layer is situated between the supporting substrate and the hydrogenated amorphous silicon photogenerating layer.

4. An imaging member in accordance with claim 3, wherein the hydrogenated amorphous silicon photogenerating layer is overcoated by a transparent and partially conductive passivation layer.

5. An imaging member in accordance with claim 1, wherein the hydrogenated amorphous silicon photogenerating layer is situated between the supporting substrate and the silicon oxide charge transport layer.

6. An imaging member in accordance with claim 1, wherein the photogenerating layer is comprised of hydrogenated amorphous silicon doped with phosphorous or boron separately or simultaneously in an amount of from about 2 parts per million to about 100 parts per million.

7. An imaging member in accordance with claim 1, wherein the photogenerating layer is comprised of an hydrogenated amorphous silicon-germanium alloy.

8. An imaging member in accordance with claim 1, wherein the photogenerating layer is comprised of an hydrogenated amorphous silicon-tin alloy.

9. An imaging member in accordance with claim 1, wherein the photogenerating layer is comprised of an hydrogenated amorphous carbon-germanium alloy.

10. An imaging member in accordance with claim 1, wherein the transport layer of silicon oxide is prepared by the glow discharge of a mixture of a silane gas and a gaseous nitrogen oxygen compound.

11. An imaging member in accordance with claim 1, wherein the transport layer of silicon oxide is prepared by the glow discharge of a mixture of a silane gas, a gaseous nitrogen oxygen compound and a boron containing gas.

12. An imaging member in accordance with claim 1, wherein the transport layer of silicon oxide is prepared by the glow discharge of a mixture of a silane gas, a gaseous nitrogen oxygen compound and a phosphorous containing gas.

13. An imaging member in accordance with claim 1, wherein the transport layer of silicon oxide has been structurally modified by exposure to energetic radiation.

14. An imaging member in accordance with claim 13, wherein the exposure is effected with neutron bombardment and high energy gamma irradiation.

15. An imaging member in accordance with claim 2, wherein the thickness of the photogenerating layer is from about 0.1 microns to about 1.0 microns.

16. An imaging member in accordance with claim 2, wherein the thickness of the silicon oxide charge transport layer is from about 1.0 microns to about 10 microns.

17. An imaging member in accordance with claim 2, wherein the thickness of the overcoating layer is from about 0.1 microns to about 1.0 microns.

18. An imaging member in accordance with claim 3, wherein the thickness of the overcoating layer is from about 0.1 microns to about 1.0 microns.

19. An imaging member in accordance with claim 4 wherein the thickness of the overcoating layer is from about 0.1 microns to about 1.0 microns.

20. An imaging member in accordance with claim 2, wherein the overcoating layer results from plasma deposited silicon nitride, plasma deposited silicon oxynitride, plasma deposited silicon oxide, plasma deposited silicon carbide, amorphous carbon, or aluminum oxide.

21. An imaging member in accordance with claim 3, wherein the overcoating layer results from plasma deposited silicon nitride, plasma deposited silicon oxynitride, plasma deposited silicon oxide, plasma deposited silicon carbide, amorphous carbon, or aluminum oxide.

22. An imaging member in accordance with claim 4, wherein the overcoating layer results from plasma deposited silicon nitride, plasma deposited silicon oxynitride, plasma deposited silicon oxide, plasma deposited silicon carbide, amorphous carbon, or aluminum oxide.

23. An imaging member in accordance with claim 1, wherein there is present an interface transition gradient between the silicon oxide charge transport layer and the photogeneration layer.

24. A method of imaging which comprises providing the photoresponsive imaging member of claim 1, subjecting this member to imagewise exposure, developing the resulting image with a toner composition, subsequently transferring the image to a suitable substrate, and optionally permanently affixing the image thereto.

25. A method of imaging in accordance with claim 24, wherein the silicon oxide charge transport layer is situated between the supporting substrate and the hydrogenated amorphous silicon photogenerating layer, and the member further includes a protective top coating thereover.

26. A method of imaging in accordance with claim 24, wherein the hydrogenated amorphous silicon photogenerating layer is situated between the supporting substrate and the silicon oxide charge transport layer.

27. A method of imaging in accordance with claim 24, wherein the hydrogenated amorphous silicon photogenerating layer is overcoated by a transparent and partially conductive passivation layer.

28. A method of imaging in accordance with claim 24, wherein the photogenerating layer is comprised of hydrogenated amorphous silicon doped with phosphorous or boron separately or simultaneously in an amount of from about 2 parts per million to about 100 parts per million.

29. A method of imaging in accordance with claim 24, wherein the photogenerating layer is comprised of an hydrogenated amorphous silicon-germanium alloy.

30. A method of imaging in accordance with claim 24, wherein the photogenerating layer is comprised of an hydrogenated amorphous silicon-tin alloy.

31. A method of imaging in accordance with claim 24, wherein the photogenerating layer is comprised of an hydrogenated amorphous carbon-germanium alloy.

32. A method of imaging in accordance with claim 25, wherein the transport layer of silicon oxide is prepared by the glow discharge of a mixture of a silane gas and gaseous nitrogen oxygen compound gas.

33. A method of imaging in accordance with claim 25, wherein the transport layer of silicon oxide is prepared by the glow discharge of a mixture of a silane gas, a gaseous nitrogen oxygen compound and a boron containing gas.

34. A method of imaging in accordance with claim 25, wherein the transport layer of silicon oxide is prepared by the glow discharge of a mixture of a silane gas, gaseous nitrogen oxygen compound and a phosphorous containing gas.

35. A method of imaging in accordance with claim 25, wherein the thickness of the photogenerating layer is from about 0.1 microns to about 1.0 microns.

36. A method of imaging in accordance with claim 25, wherein the thickness of the silicon oxide charge transport layer is from about 1.0 microns to about 10 microns.

37. A method of imaging in accordance with claim 25, wherein the thickness of the overcoating layer is from about 0.1 microns to about 1.0 microns.

38. An imaging member in accordance with claim 25, wherein the overcoating layer results from plasma deposited silicon nitride, plasma deposited silicon oxynitride, plasma deposited silicon oxide, plasma deposited silicon carbide, amorphous carbon, or aluminum oxide.

39. A method of imaging in accordance with claim 25, wherein there is present an interface transition gradient between the silicon oxide charge transport layer and the photogenerating layer.

40. A method of imaging in accordance with claim 26, wherein the hydrogenated amorphous silicon photogenerating layer is overcoated by a transparent and partially conductive passivation layer.

41. A method of imaging in accordance with claim 26, wherein the photogenerating layer is comprised of hydrogenated amorphous silicon doped with phosphorous or boron separately or simultaneously in an amount of from about 2 parts per million to about 100 parts per million.

42. A method of imaging in accordance with claim 26, wherein the photogenerating layer is comprised of an hydrogenated amorphous silicon-germanium alloy.

43. A method of imaging in accordance with claim 26, wherein the photogenerating layer is comprised of an hydrogenated amorphous silicon-tin alloy.

44. A method of imaging in accordance with claim 26, wherein the photogenerating layer is comprised of an hydrogenated amorphous carbon-germanium alloy.

45. A method of imaging in accordance with claim 26, wherein the transport layer of silicon oxide is prepared by the glow discharge of a mixture of a silane gas and gaseous nitrogen oxygen compound gas.

46. A method of imaging in accordance with claim 26, wherein the transport layer of silicon oxide is prepared by the glow discharge of a mixture of a silane gas, a gaseous nitrogen oxygen compound and a boron containing gas.

47. A method of imaging in accordance with claim 26, wherein the transport layer of silicon oxide is prepared by the glow discharge of a mixture of a silane gas, gaseous oxygen compound and a phosphorous containing gas.

48. A method of imaging in accordance with claim 26, wherein the thickness of the photogenerating layer is from about 0.1 microns to about 1.0 microns.

49. A method of imaging in accordance with claim 26, wherein the thickness of the silicon oxide charge transport layer is from about 1.0 microns to about 10 microns.

50. A method of imaging in accordance with claim 26, wherein the thickness of the overcoating layer is from about 0.1 microns to about 1.0 microns.

51. A method of imaging in accordance with claim 25, wherein the overcoating layer results from plasma deposited silicon nitride, plasma deposited silicon oxynitride, plasma deposited silicon oxide, plasma deposited silicon carbide, amorphous carbon, or aluminum oxide.

52. A method of imaging in accordance with claim 26, wherein there is present an interface transition gradient between the silicon oxide charge transport layer and the photogeneration layer.

53. An imaging member in accordance with claim 1, wherein from about 10 atomic percent to about 40 atomic percent of hydrogen is present in the amorphous silicon photogenerating layer.

54. An imaging member in accordance with claim 1, wherein the supporting substrate is aluminum.

55. An imaging member consisting essentially of a supporting substrate, a photogenerating layer of hydrogenated amorphous silicon with from about 10 to about 40 atomic percent hydrogen, and in contact therewith a charge transporting layer of plasma deposited silicon oxide of a thickness exceeding 1 micron and containing containing at least 50 atomic percent of hydrogen.

56. An imaging member in accordance with claim 55, wherein the silicon oxide transport layer situated between the supporting substrate and the hydrogenated amorphous silicon photogenerating layer.

57. An imaging member in accordance with claim 55, wherein there is further included a top transparent and partially conductive overcoating layer.

58. An imaging member in accordance with claim 55, wherein the overcoating layer is selected from the group consisting of plasma deposited silicon nitride, plasma deposited silicon carbide, plasma deposited silicon oxide, and amorphous carbon.

59. An imaging member in accordance with claim 1 wherein the thickness of the plasma deposited silicon oxide transport layer is from about 1 to about 25 microns.

60. An imaging member in accordance with claim 55 wherein the thickness of the charge transporting layer of plasma desposited silicon oxide is from about 1 to about 25 microns.

61. An imaging member in accordance with claim 1 wherein the thickness of the plasma deposited silicon oxide transport layer is from about 1 to about 10 microns.

62. An imaging member in accordance with claim 55 wherein the thickness of the charge transporting layer of plasma deposited silicon oxide is from about 1 to about 10 microns.

* * * * *